US006637243B2

(12) United States Patent
Lemley et al.

(10) Patent No.: US 6,637,243 B2
(45) Date of Patent: Oct. 28, 2003

(54) INTERNAL COMPONENT LOCK

(75) Inventors: Russ Lemley, Chandler, AZ (US); Aric Clawson, Phoenix, AZ (US)

(73) Assignee: Mobile Mini, Inc., Tempe, AZ (US)

( * ) Notice: Subject to any disclaimer, the term of this patent is extended or adjusted under 35 U.S.C. 154(b) by 0 days.

(21) Appl. No.: 09/877,472

(22) Filed: Jun. 8, 2001

(65) Prior Publication Data

US 2002/0184929 A1 Dec. 12, 2002

(51) Int. Cl.[7] ..... E05B 67/38
(52) U.S. Cl. ..... 70/56; 70/417; 70/423
(58) Field of Search ..... 70/2, 32–34, 54–56, 70/416, 417, 424, 426, 428

(56) References Cited

U.S. PATENT DOCUMENTS

| | | | | | |
|---|---|---|---|---|---|
| 3,798,938 | A | * | 3/1974 | McCullum | 70/417 |
| 3,996,774 | A | * | 12/1976 | Best | 70/417 X |
| 4,183,235 | A | * | 1/1980 | Coralli et al. | 70/417 X |
| 5,261,258 | A | | 11/1993 | Bunger | |
| 5,509,700 | A | | 4/1996 | Kennedy, Jr. | |
| 5,711,506 | A | * | 1/1998 | Stillwagon | 70/417 X |
| 5,802,896 | A | * | 9/1998 | Tsai | 70/417 |
| 5,884,512 | A | * | 3/1999 | Wayne | 70/417 X |
| 5,931,032 | A | * | 8/1999 | Gregory | 70/56 X |
| 5,953,943 | A | * | 9/1999 | DeMario, Jr. | 70/417 |
| 6,009,731 | A | * | 1/2000 | Emmons et al. | 70/417 X |
| 6,036,240 | A | * | 3/2000 | Hamilton et al. | 70/417 X |
| 6,079,240 | A | * | 6/2000 | Shvarts | 70/423 X |
| 6,185,966 | B1 | * | 2/2001 | Chen | 70/417 X |
| 6,434,986 | B1 | * | 8/2002 | Rice et al. | 70/417 X |

OTHER PUBLICATIONS

American Lock Model #2000CC, printout of page from web site.

* cited by examiner

*Primary Examiner*—Suzanne Dino Barrett
(74) *Attorney, Agent, or Firm*—Frank J. McGue

(57) ABSTRACT

An improved internal component lock for storage containers is disclosed which comprises a body having a hasp space, a keyway and a retaining space. The hasp space, the keyway and a retaining space are joined within said body. The keyway has a locking mechanism contained therein. The locking mechanism actuates a shackle which is adapted to slidably extend from the locking mechanism across the hasp space to the retaining space when the locking mechanism is in the locked position. The shackle engages a hasp extending into the hasp space in the locked position while being retained within locking mechanism in the unlocked position. At least two retaining pins have a shaped upper edge adapted to deter drilling and are vertically mounted on either side of the retaining space to retain the shackle therewithin when in the locked position.

7 Claims, 9 Drawing Sheets

INTERNAL COMPONENT LOCK

TECHNICAL FIELD

This invention relates to an improved lock, in particular, to an improved internal component lock for use with storage containers.

BACKGROUND OF THE INVENTION

Although the prior art shows internal locks for containers, none are believed to illustrate the type of device disclosed and claimed. The term "internal component lock" as used herein is a device having a housing with an internally mounted retaining device which engages a hasp inserted into an opening extending into said housing.

Storage containers referred to in the present specification are generally large, walk in boxes similar in size to semi-trailer trucks. The containers can be stacked and shipped by rail and by ship easily. In addition, such containers are used as storage devices by end users.

With any such container, maintaining security for the contents is a prime concern. Because such containers are often left unattended, they become targets for thieves and other criminals. Thus, the manufacturers and users of such containers continue to seek and develop better security techniques while the criminal element continues to develop methods for attacking and circumventing those security measures.

Various types of locks have been described in the prior art. Typical of padlock type devices is described in U.S. Pat. No. 5,261,258 entitled "Padlock Protector" which issued on Nov. 16, 1993 and is owned by assignee of the present invention discloses a security device which consists of an exterior mounted housing for a latch bar which defines a recess. The recess provides access to an aperture in the bar by a circular shackle of a disk shaped padlock.

However, padlocks in general provide a point of attack for thieves, namely, the exposed shackle thereof. Thus, there is a need for a device which does provide this point of attack for would be thieves.

U.S. Pat. No. 5,509,700 entitled "Latch and Lock for Trailer Doors" which issued on Apr. 23, 1996 to Kennedy, Jr., and owned by the assignee of the present invention, shows use of an internal lock 81 in FIGS. 10 and 11 to secure a trailer door.

American Lock of Crete, Ill., has a Series 2000CC lock in which a retaining pin or shackle is mounted within a steel housing. A hasp is inserted into a hasp space and engaged by the retaining pin whereby that pin and the hasp itself are not directly accessible to a potential thief.

However, the present invention improves upon the prior art in a number of ways described below. None of the known prior art disclose the device set forth herein.

SUMMARY OF THE INVENTION

It is an object of this invention to provide an improved internal component lock for storage containers which provides additional security therefore.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
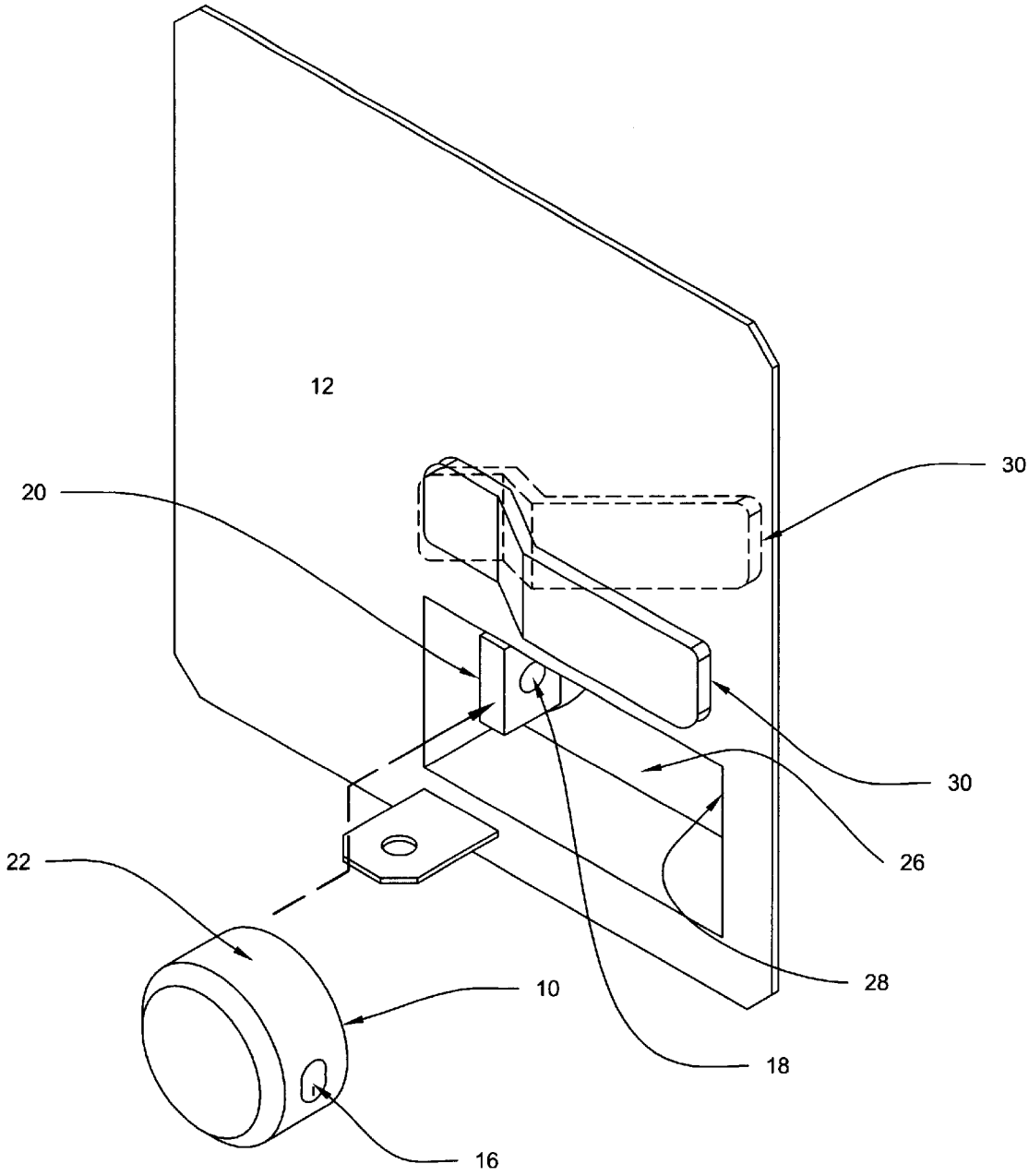
FIG. 1 is a perspective front and side view of a storage container using a lock embodying the present invention.
Figure 2:
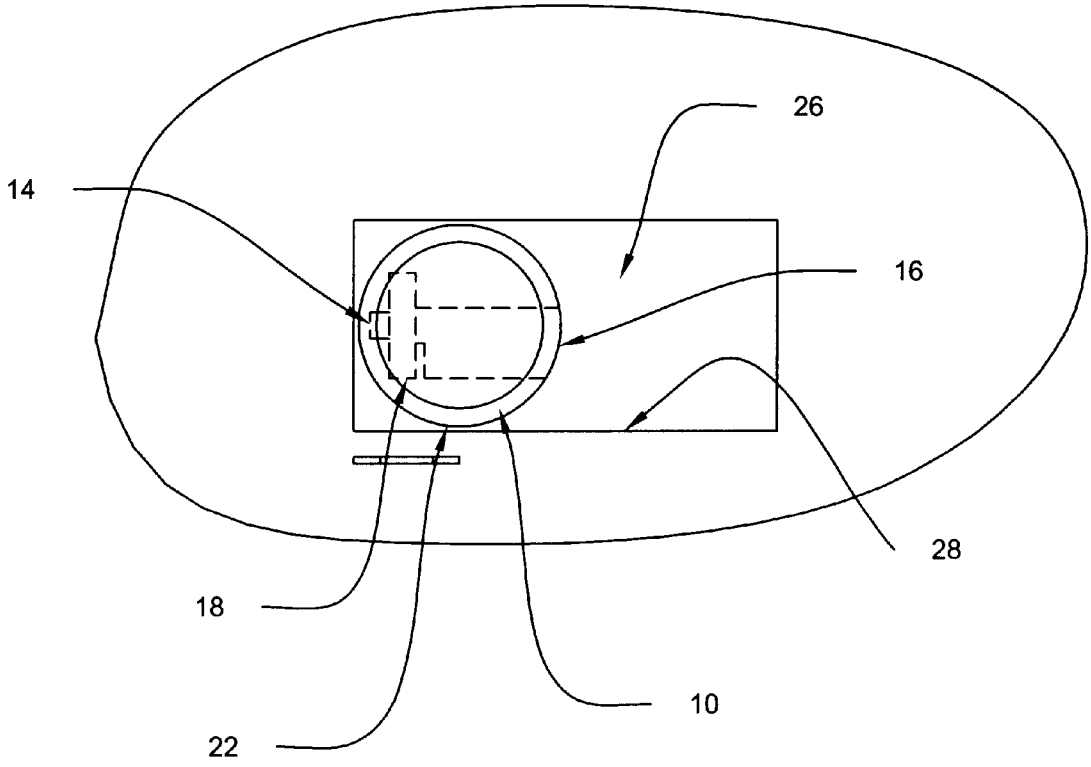
FIG. 2 is a front partial cross sectional view of the embodiment of FIG. 1.

Referring more particularly to the drawings by characters of reference, FIGS. 1–6 disclose one embodiment of an improved lock 10 mounted to a door 12. As illustrated in FIGS. 1 and 2, lock 10 includes a concealed shackle 14 actuated by a locking mechanism 16. Shackle 14 is extended through a hasp 17, the hasp 17 comprising an eyelet 18 of a tab 20 by operation of a key (not shown) in locking mechanism 16. Handle 30 moves between a locked position and an unlocked position (in shadow) thereby actuating the door lock and moving tab 20.

Lock 10 includes a relatively massive body 22 preferably comprised of solid steel, hardened by heat treating. Massive body 22 has a hasp space 24 which encloses eyelet 18 and tab 20. Lock 10 includes a flat lower surface 25 which fits against an inner surface 26 of a recess 28 in door 12. The height or thickness of body 22 is preferably less than the depth of recess 28 thereby preventing vertical access to lock 10. Such prevention protects lock 10 from attack from, for example, a hammer.

As further protection, body 22 is preferably made from a hard steel. Body 22 itself is preferably made in a tamper resistant shape 60 adapted to avoid easy engagement by tooling. Such shapes are best seen FIGS. 6A–6D. Examples are sloped sides 62 of FIG. 6A, hemisphere 64 of FIG. 6B, curved sides 66 of FIGS. 6C and 6D. The shape is adapted to allow a tool (i.e. a wrench) to slide out of engagement in contrast to square of FIG. 6E.

Note that if a round shape of body 22 is used, then lock 10 can be made by simple cutting from round steel stock.

Figure 3:
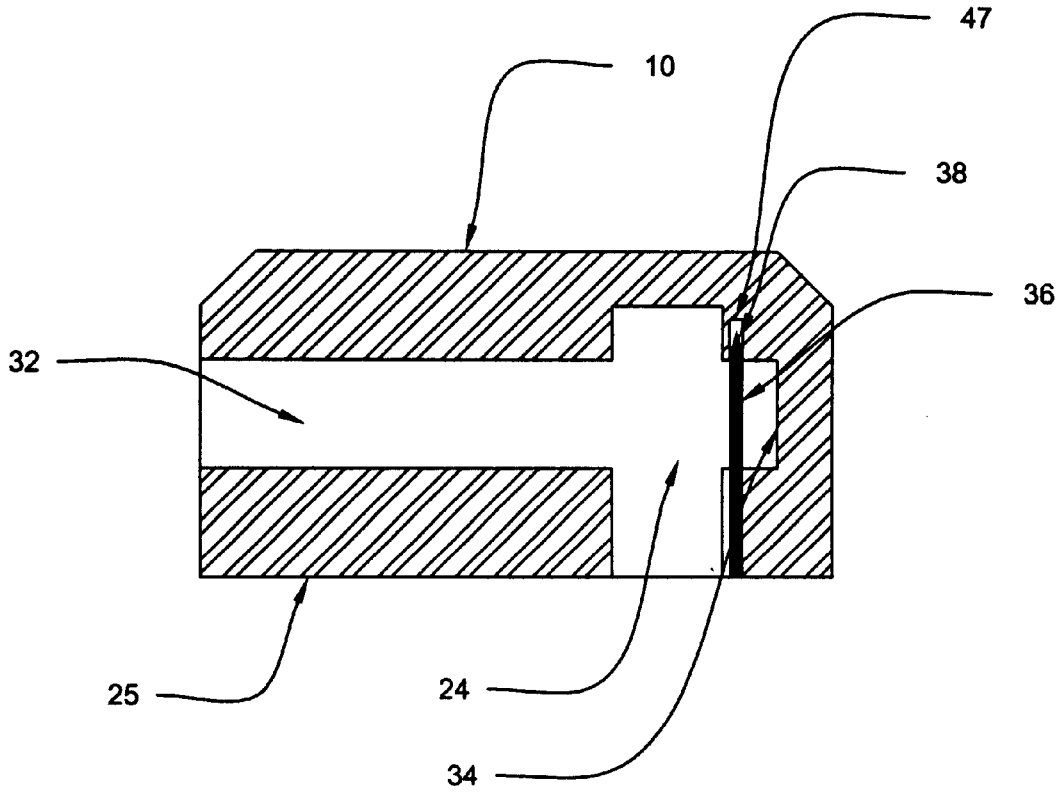
FIG. 3 is a cross sectional side schematic view of the embodiment of FIG. 1.
Figure 4:
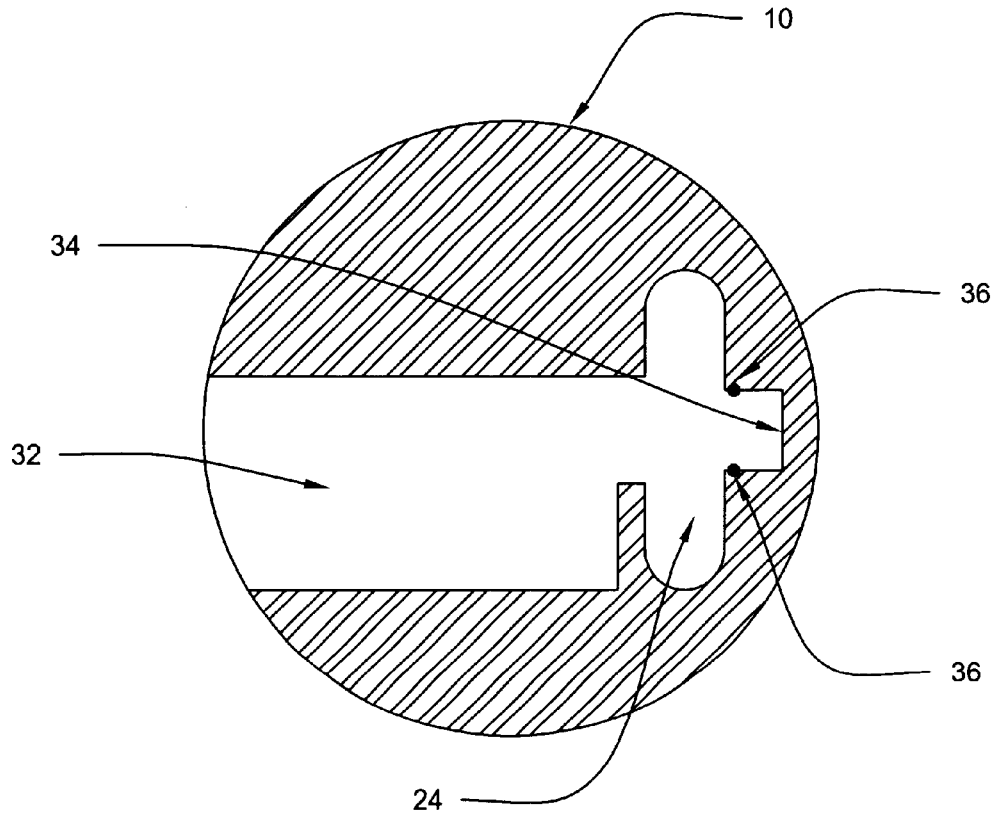
FIG. 4 is a cross sectional top view of the embodiment of FIG. 1.
Figure 5:
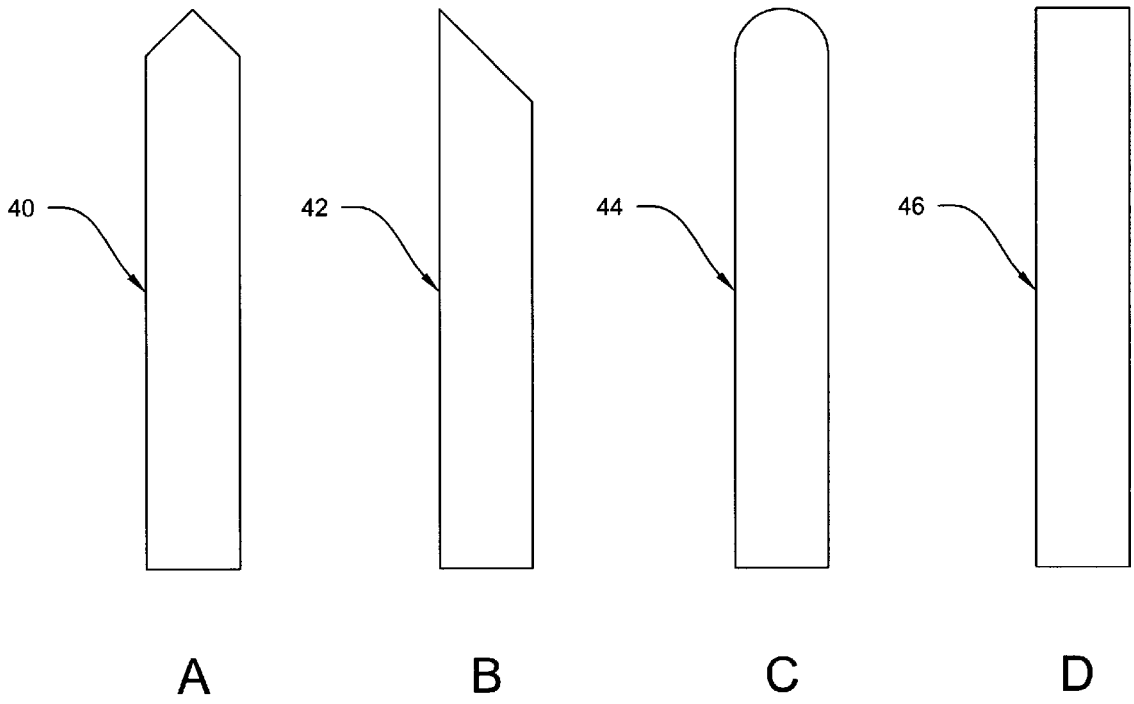
FIGS. 5A–5D show alternate embodiments of a retaining pin used in the present invention.
Figure 6:
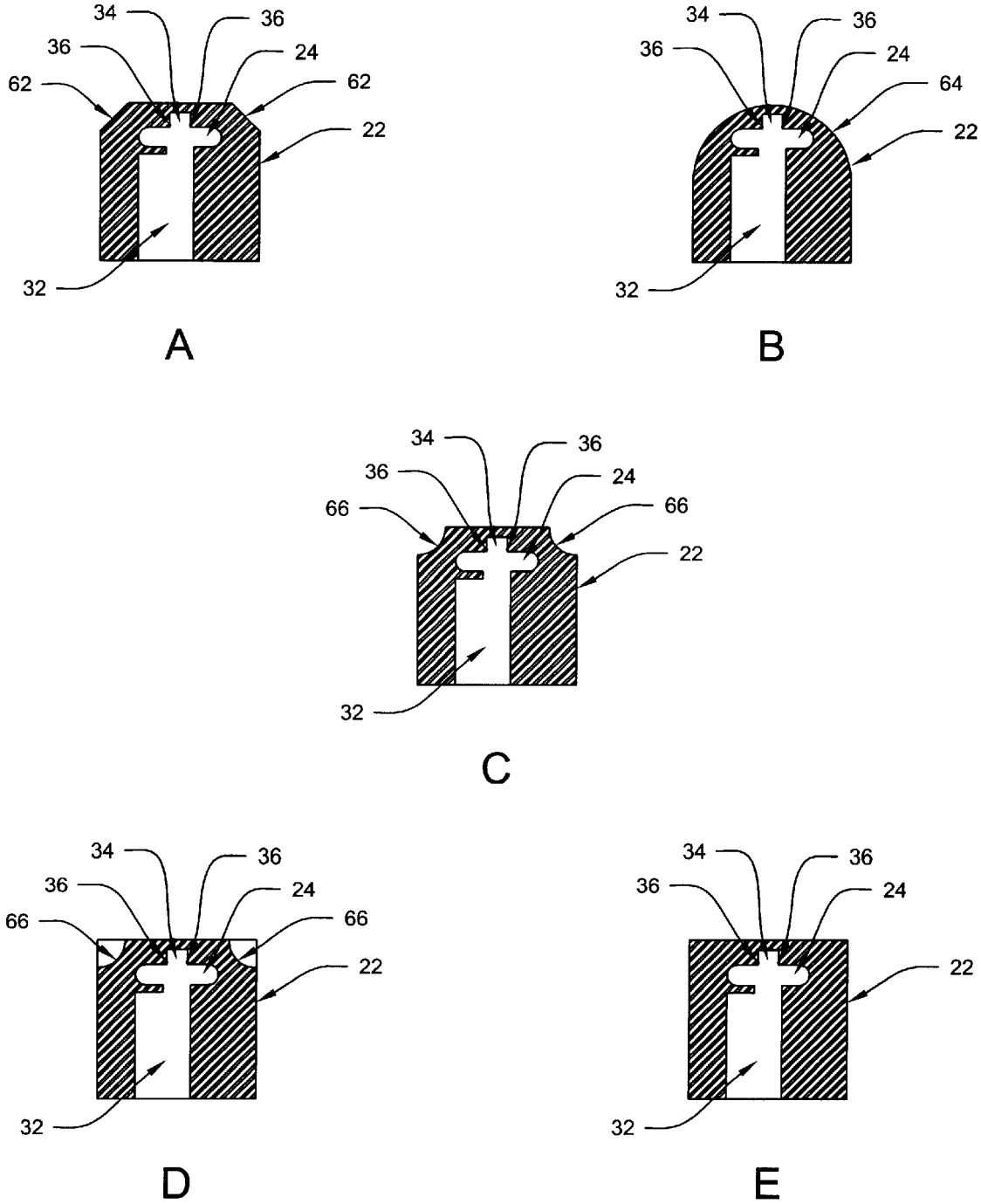
FIGS. 6A–6E show alternate shapes employable in the present invention.
Figure 7:
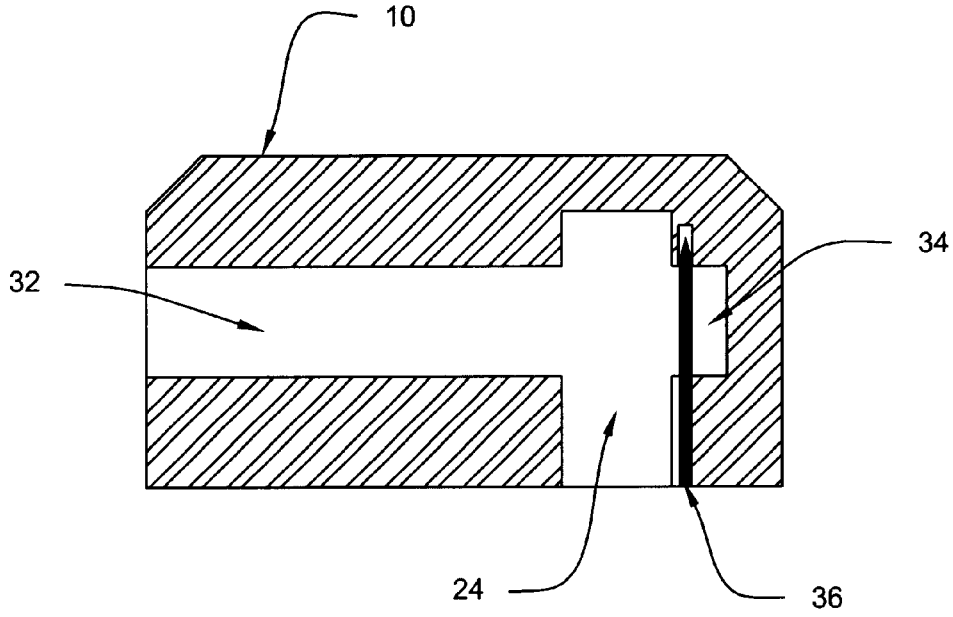
FIG. 7 is a cross sectional side schematic view of another embodiment.
Figure 8:
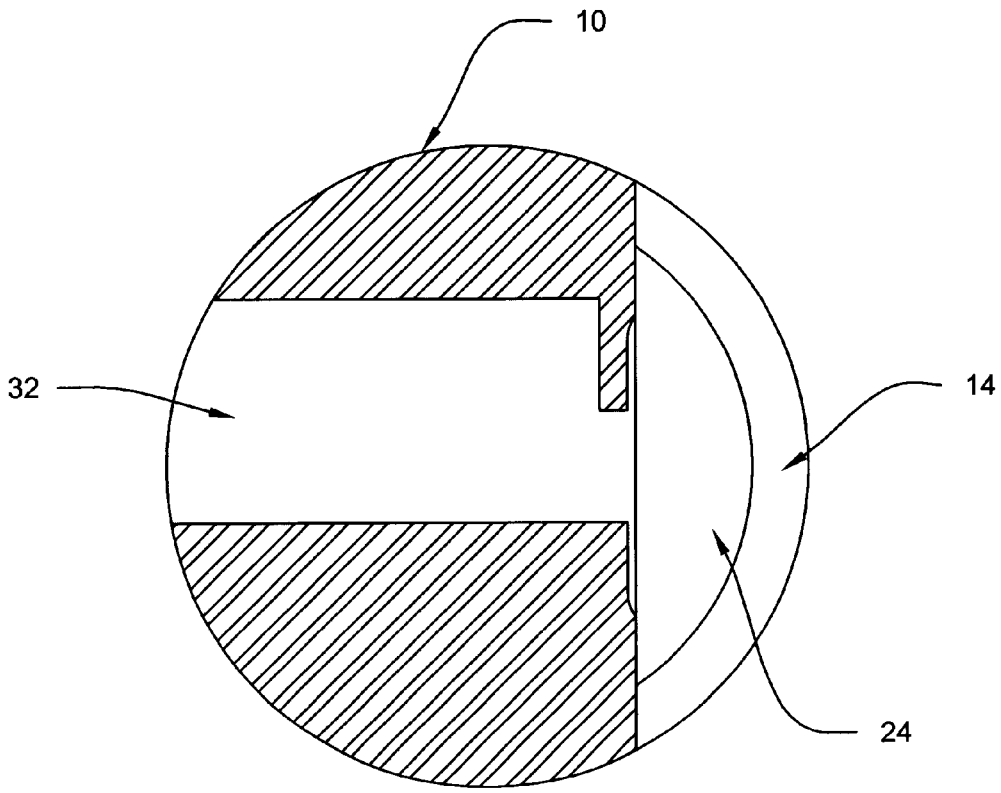
FIG. 8 is a cross sectional top view of the embodiment of FIG. 7.

As best seen in FIGS. 3 and 4, hasp space 24, a keyway 32 and a retaining space 34 are joined whereby hasp space 24 forms the arms and keyway 32 forms the lower leg while retaining space 34 forms the upper leg of a lower case t. Locking mechanism 16 is positioned within keyway 32. Shackle 14 slidably extends from locking mechanism 16 and, in the locked position, extends across hasp space 24 to enter retaining space 34. In an unlocked position, shackle 14 is retained within locking mechanism 16 and does not extend into hasp space 24. Shackle 14 is retained within body 22 by a set screw 23 which is positioned to prevent access when lock 10 is in the locked position.

A pair of retaining pins 36, preferably comprised of solid, heat treated and hardened steel, are vertically mounted on either side of retaining space 34 to retain shackle 14 therewithin when in the locked position. In the preferred embodiment, each retaining pin 36 is provided with shaped upper edge 38 as a deterrence to drilling out said pins. Such shapes can include a cone shaped tip 40 as shown in FIG. 5A, a sloped tip 42 as shown in FIG. 5B or a rounded tip 44 as shown in FIG. 5C instead of a simple flat tip 46 shown in FIG. 5D. Further, an air gap 47 is provided between body 22 and the top of tips 42, 44 and 46 of pin 36 which prevents a smooth drilling transition between the material of body 22 and the material of pin 36. When someone attempts to drill out retaining pins 36, shaped upper edge 38 is adapted to push the drill bit to the side thereby maintaining the structural integrity of pins 36 and hence lock 10.

Figure 9:
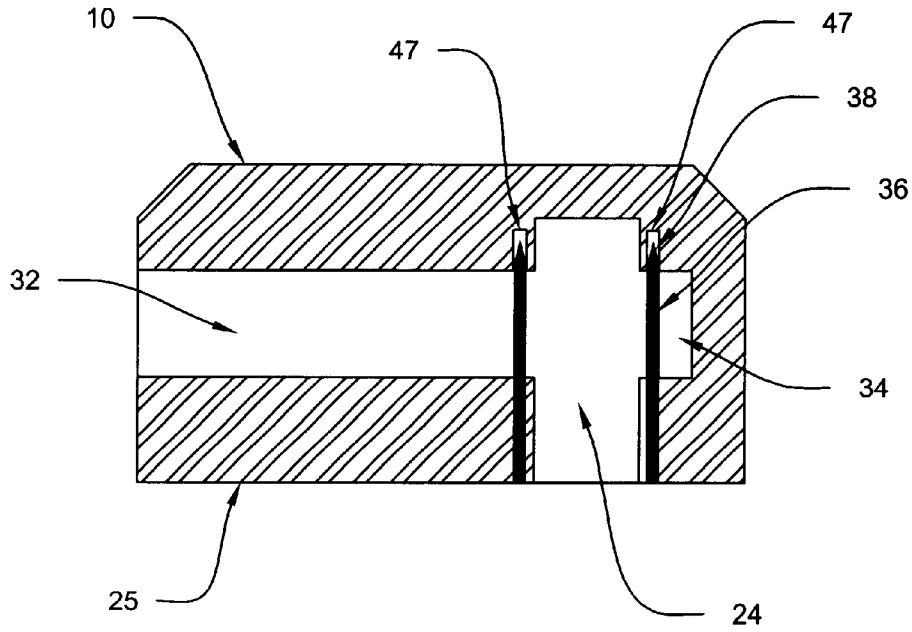
FIG. 9 is a cross sectional view of an alternate embodiment of the present invention using four pins.

To provide even further protection, a second pair of retaining pins 36 as best seen in FIG. 9 can be employed.

To install pins 36 into body 22, the holes in body 22 are machined slightly smaller than the diameter of pins 36. Body 22 is then heated whereby the holes expand slightly allowing pins 36 to be press fit into the holes. As body 22 cools, the contraction of the holes about pins 36 prevents pins 36 from being removed or rotated.

One advantage of employment of flat lower surface 25 is that configuration allows body 22 to be significantly thicker in the position of retaining pins 36 than those locks described in the prior art. In addition, the flat lower surface 25 in conjunction with inner surface 26 prevents the driving of retaining pins 36 through the back of body 22.

Further protection is provided by a shield adapted to provide drilling resistance which is positioned directly above retaining space 34. In one embodiment, the shield is a pin extending inwardly along and above retaining space 34. In another embodiment, the shield is a wafer positioned above retaining space 34. In the preferred embodiment, the wafer is an extremely strong tungsten carbide material which is very difficult to drill through.

Additionally, the wafer is loosely fit into body 22 whereby the wafer will rotate when contacted by a drill bit, thereby preventing the drill bit from cutting through the wafer.

What is claimed is:

1. An improved internal component lock for storage containers comprises:

a body having a hasp space, a keyway and a retaining space, the hasp space, the keyway and the retaining space being joined within said body;

the keyway having a locking mechanism contained therein, the locking mechanism having a shackle actuated thereby, the shackle adapted to slidably extend from the locking mechanism across the hasp space to the retaining space when the locking mechanism is in the locked position and engaging a hasp extending into the hasp space, the shackle being retained with in locking mechanism in the unlocked position;

at least two retaining pins having a shaped upper edge adapted to deter drilling, the at least two retaining pins being vertically mounted on either side of the retaining space to retain the shackle therewithin in the locked position; and a air gap defined by the top of the at least two pins and the body.

2. The improved internal component lock of claim 1 wherein the hasp space forms the arms and the keyway forms the lower leg and the retaining space forms the upper leg of a t.

3. The improved internal component lock of claim 1 comprising two retaining pins.

4. The improved internal component lock of claim 1 wherein the body is provided with holes for the least two retaining pins whereby the holes being slightly smaller than the diameter of the at least two retaining pins, the lock body being heated to expand the holes to allow insertion of the at least two retaining pins, the holes when cooled constricting about the at least two retaining pins thereby preventing movement of the at least two retaining pins.

5. The improved internal component lock of claim 1 further comprising a flat lower surface.

6. The improved internal component lock of claim 1 wherein the body having a tamper resistant shape adapted to avoid easy engagement by tooling.

7. The improved internal component lock of claim 1 wherein the body is made of a hardened steel.

* * * * *